US008869408B2

(12) United States Patent
Votolato

(10) Patent No.: US 8,869,408 B2
(45) Date of Patent: Oct. 28, 2014

(54) BAG CUTTER AND PIERCER

(71) Applicant: Earl Votolato, Newport Beach, CA (US)

(72) Inventor: Earl Votolato, Newport Beach, CA (US)

(73) Assignee: The Votolato Living Trust, Newport Beach, CA (US)

( * ) Notice: Subject to any disclaimer, the term of this patent is extended or adjusted under 35 U.S.C. 154(b) by 64 days.

(21) Appl. No.: 13/653,920

(22) Filed: Oct. 17, 2012

(65) Prior Publication Data

US 2013/0340262 A1 Dec. 26, 2013

Related U.S. Application Data

(63) Continuation-in-part of application No. 13/546,212, filed on Jul. 11, 2012, which is a continuation-in-part of application No. 13/528,473, filed on Jun. 20, 2012.

(51) Int. Cl.
*B26B 3/00* (2006.01)
*B67B 7/00* (2006.01)

(52) U.S. Cl.
USPC ..... 30/294; 30/280

(58) Field of Classification Search
USPC ..... 30/2, 123, 142, 175, 186, 294, 299
See application file for complete search history.

(56) References Cited

U.S. PATENT DOCUMENTS

| | | | | |
|---|---|---|---|---|
| 1,082,400 | A | 12/1913 | Burnite | |
| 1,216,899 | A | 2/1917 | Weyer | |
| 1,553,449 | A * | 9/1925 | Kennedy | 30/294 |
| 2,033,050 | A | 3/1936 | Pankonin | |
| 2,649,656 | A | 8/1953 | Hedrick | |
| 2,881,520 | A | 4/1959 | Mito | |
| 3,142,426 | A | 7/1964 | Busse | |
| 3,727,272 | A | 4/1973 | Rhodes | |
| D235,306 | S | 6/1975 | Christian et al. | |
| D256,883 | S | 9/1980 | Wharmby | |
| D276,786 | S | 12/1984 | Chen | |
| 4,530,154 | A | 7/1985 | DiCarlo | |
| 4,581,823 | A | 4/1986 | Gilman | |
| 4,711,031 | A | 12/1987 | Annello | |
| D298,210 | S | 10/1988 | Hutson et al. | |
| 4,887,335 | A | 12/1989 | Folkmar | |
| 4,887,355 | A | 12/1989 | Colbert | |
| 5,007,171 | A | 4/1991 | Horning, Jr. | |
| 5,285,577 | A * | 2/1994 | Carney et al. | 30/294 |
| 5,561,905 | A * | 10/1996 | Sherman | 30/280 |
| D419,417 | S | 1/2000 | Kane | |

(Continued)

FOREIGN PATENT DOCUMENTS

| | | |
|---|---|---|
| GB | 2234699 | 2/1994 |
| JP | 2000-279659 | 10/2000 |
| WO | 2008/086101 | 7/2008 |

*Primary Examiner* — Hwei C Payer
(74) *Attorney, Agent, or Firm* — Fish & Tsang LLP

(57) ABSTRACT

A bag cutter for opening a sealed package using at least one of a blade and a piercer. Preferably, at least one blade is disposed partially within a cutout of an arm in a manner that exposes an edge of the blade. A piercer can comprise an extension of a cutout edge or be located on any other suitable portion of an arm. Another blade can be provided that is substantially perpendicular to the blade within a cutout, and juxtaposable against a cutting surface.

19 Claims, 8 Drawing Sheets

(56) References Cited

U.S. PATENT DOCUMENTS

| | | | | |
|---|---|---|---|---|
| 6,658,742 | B2 | 12/2003 | Votolato | |
| 6,857,192 | B1 * | 2/2005 | Summers et al. | 30/294 |
| 6,966,244 | B2 * | 11/2005 | Herbst et al. | 81/418 |
| 7,073,264 | B2 | 7/2006 | Votolato | |
| D542,104 | S | 5/2007 | Holcolmb et al. | |
| 7,506,445 | B2 | 3/2009 | Buyse et al. | |
| 7,891,100 | B2 | 2/2011 | Gelardi et al. | |
| 7,958,639 | B2 * | 6/2011 | Ireland | 30/2 |
| 2005/0102844 | A1 | 5/2005 | Addis | |
| 2006/0196018 | A1 | 9/2006 | Taylor et al. | |

* cited by examiner

BAG CUTTER AND PIERCER

This application is a continuation-in-part of U.S. patent application Ser. No. 13/546,212, filed on Jul. 11, 2012 which is a continuation-in-part of U.S. patent application Ser. No. 13/528,473, filed on Jun. 20, 2012. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is bag cutters.

BACKGROUND

The following background discussion includes information that may be useful in understanding the present invention. It is not an admission that any of the information provided herein is prior art or relevant to the presently claimed invention, or that any publication specifically or implicitly referenced is prior art.

Employment of sealed bags for housing various products is a well-accepted packaging approach. While such bags are highly desirable for their efficiency in maintaining product integrity, access into the contents of such bags is often inconvenient, and contents often spill due to messy cuts and tears.

Various bag cutters are available that attempt to overcome some of the problems described above. Such cutters include the devices described in International Patent Application Publication No. 2008/086101, United States Patent Publication No. 2005/0102844, and U.S. Pat. Nos. 7,073,264, 6,658,742, 4,887,355, and 5,007,171.

Existing bag cutters are not as versatile, durable, or safe as could be desired. Thus, there is still a need for improved cutting devices.

SUMMARY OF THE INVENTION

The inventive subject matter provides apparatus, systems and methods for opening various objects, especially plastic bags, using a cutting device having a blade, a cutout, and a piercer. Devices of the inventive subject matter provide safe, durable, or versatile cutters for a wide range of uses.

Some preferred bag cutters have two arms, which can advantageously be injection molded as a single, continuous piece of plastic. Alternatively, the arms can be two discontinuous pieces of material coupled to a pivot. Some contemplated bag cutters comprise a single arm that comprises all components of the device (e.g., embodiments without an anvil).

In some embodiments having two arms, it is contemplated that one arm partially encloses a blade, and another arm comprises a cutting surface juxtaposable against an edge of the blade.

Contemplated arms have a cutout that partially encloses a blade. Preferably, a piercer, extending from the cutout or any other portion of the cutter, is configured to pierce a bag or other object. Piercers can be used in conjunction with a blade to create a cut, or be used independent of a blade simply to pierce a bag. Piercing a bag can be useful where sealed bags are taken to high elevation locations (to keep them from exploding and creating a mess), where a user wishes to depuff bags without opening them (e.g., for shipping purposes), and so forth. A piercer can be made of the same piece of material as an arm, or comprise a separate piece of material coupled with the arm.

Bag cutters can have one, two, or even more blades, cutouts, piercers, and cutting surfaces (e.g., anvils, raised portions, or any other surface that could be used in conjunction with an edge of a blade to create a cut). Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Contemplated devices could typically be used in at least two of the following ways: (1) placing a bag between a cutting surface and a blade and squeezing the arms while sliding across the bag; (2) piercing a bag by sliding the piercer through a portion of the bag; (3) sliding a bag through a cutout exposing a blade, or (4) a combination thereof.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Figure 1:
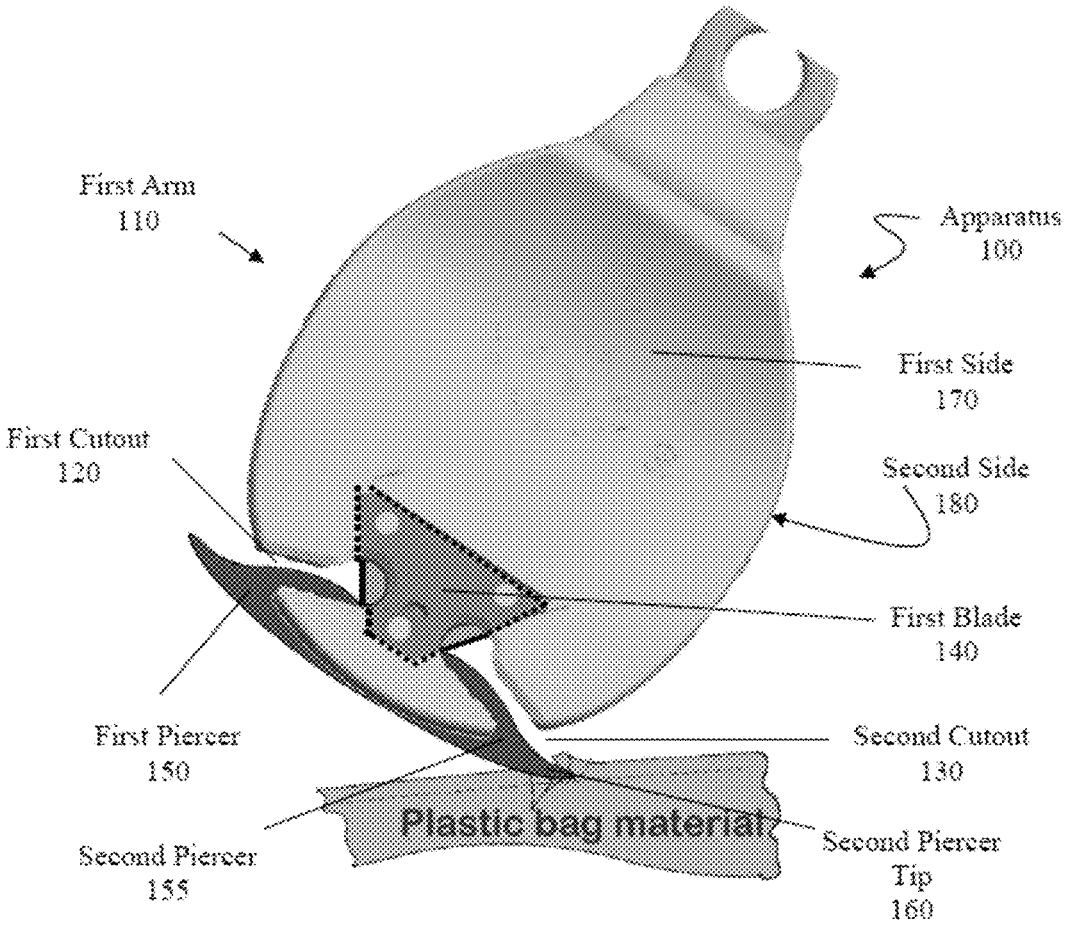
FIG. 1 is a top view of an arm of an open bag cutter having a piercer.

FIG. 1 shows a bag cutter having a piercer and two cutouts sharing a blade. Cutting and piercing apparatus 100 comprises a first arm 110 having first and second cutouts (120 and 130, respectively) that share first blade 140. First blade 140 is partially embedded between a first and second side (170 and 180, respectively) of arm 110, and is partially exposed via first cutout 120 and second cutout 130.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Apparatus 100 further comprises a first piercer 150, and second piercer 155 having piercer tip 160 that composes a periphery of first arm 110. Piercers 150 and 155 are made of a single piece of plastic, and attached to second side 180 of first arm 110 such that there is an overlap between first cutout 120 and first piercer 150, and between second cutout 130 and second piercer 155. This configuration is designed to allow a user to pierce and cut a work-piece (e.g., a bag, a sheet, etc.) with one swipe of the hand.

First and second piercers can comprise a single piece of material (as shown in FIG. 1), or comprise two or more pieces of material. It is also contemplated that an apparatus can have three of more piercers, made of one or more pieces of material. Contemplated piercer materials include, among other things, a plastic, a silicon, a metal, or any combination thereof.

Figure 2:
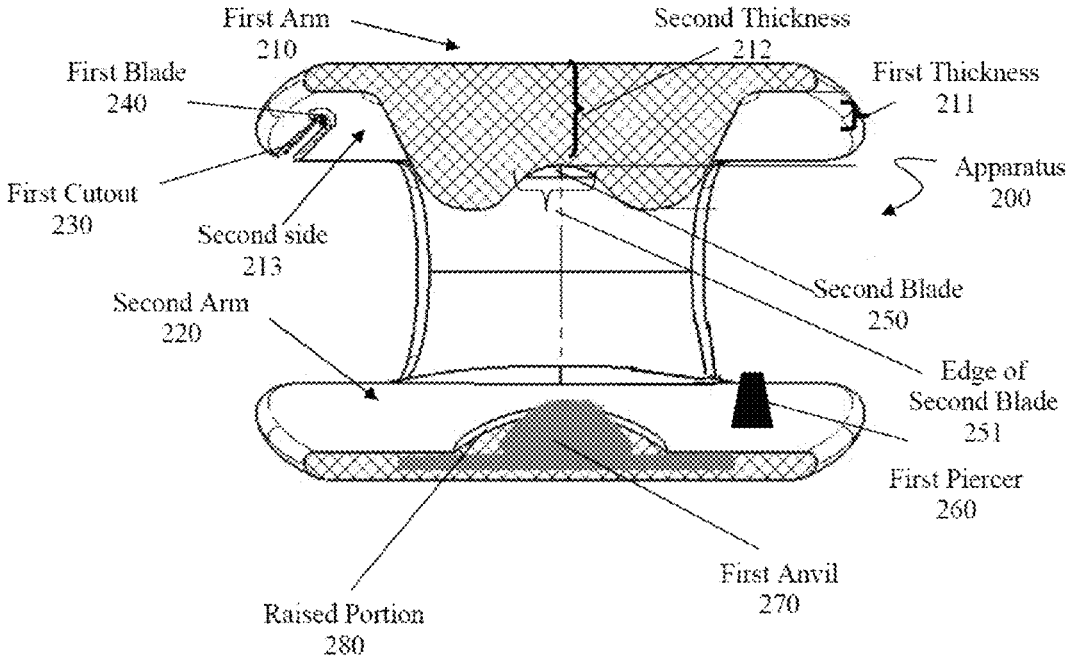
FIG. 2 is a front view of one embodiment of a bag cutter having a piercer, a blade, and an anvil.

FIG. 2 shows a bag cutter having a cutout, anvil and piercer. Apparatus 200 comprises a first arm 210 having first cutout 230, first blade 240 partially embedded therein, and second blade 250. Second arm 220 is continuous with first arm 210 and comprises a first piercer 260, and a cutting surface (first anvil 270 or raised portion 280) configured to juxtapose an edge 251 of second blade 250. First anvil 270 acts as a cutting surface where it extends through a raised portion 280. If anvil 270 wears down (or if anvil was completely embedded within second arm 220), raised portion 280 can become the cutting surface.

Piercer 260 comprises an obtuse (i.e., blunt) tip for safety and utility purposes. However, it is contemplated that piercer could comprise a tip of any suitable size and shape, including for example, a needlepoint (could come with a hard cover), a semi-blunt point, a rounded blunt point, a flat blunt point, or any other suitable shape.

Second blade 250 is partially embedded in first arm 210 in a manner that exposes an edge of blade 250. Unlike first blade 240, which is disposed between a first and second side of first arm 210, second blade 250 extends beyond at least one of the first and second sides. In other words, while an edge of first blade 240 is within a thickness 211 of first arm 210, an edge of second blade 250 sticks out from first arm 210.

It is contemplated that an arm could have multiple and varying thicknesses. A "side" of an arm is a surface that comprises one side of all thicknesses thereof. Thus, a "side" is not always a flat surface. For example, first arm 210 comprises a first thickness 211, and a second thickness 212 (among others). The first side (not shown) is substantially flat, while the second side 213 is substantially flat up to an edge portion, which comprises many curvatures.

Each arm can comprise one or more components. For example, a blade juxtaposable against a raised portion or anvil can be coupled with (e.g., partially embedded in) one material of an arm, such as a hard plastic, that is directly coupled with another material of an arm, such as a soft plastic.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 3:
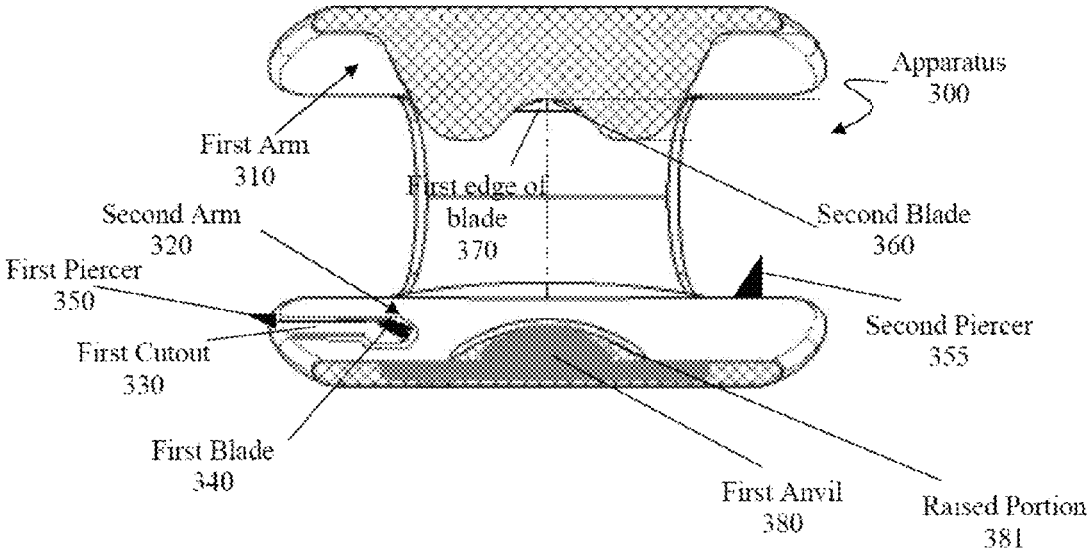
FIG. 3 is a front view of a different embodiment of a bag cutter.

FIG. 3 shows a bag cutter having a cutout, anvil, and multiple piercers. Unlike the apparatus 200 of FIG. 2, apparatus 300 comprises an anvil 380 that is completely embedded in a raised portion 381 of second arm 320. In such an embodiment, raised portion 381 acts as a cutting surface at least up to a point where raised portion 381 is worn and first anvil 380 is exposed. Where first anvil 380 becomes exposed, it will act as a cutting surface.

First arm 310 comprises a second blade 360 partially embedded therein and exposing a first edge 370. Second arm 320 comprises a first cutout 330 at least partially enclosing first blade 340, and having a first piercer 350. Second arm further comprises second piercer 355 that is distal from each of the first blade 340 and second blade 360.

It is contemplated that any arm can comprise any component of a cutting apparatus in any suitable combination. Thus, anvil(s), cutout(s), blade(s), piercer(s), and any other component can be located on any arm or arms.

Figure 4:
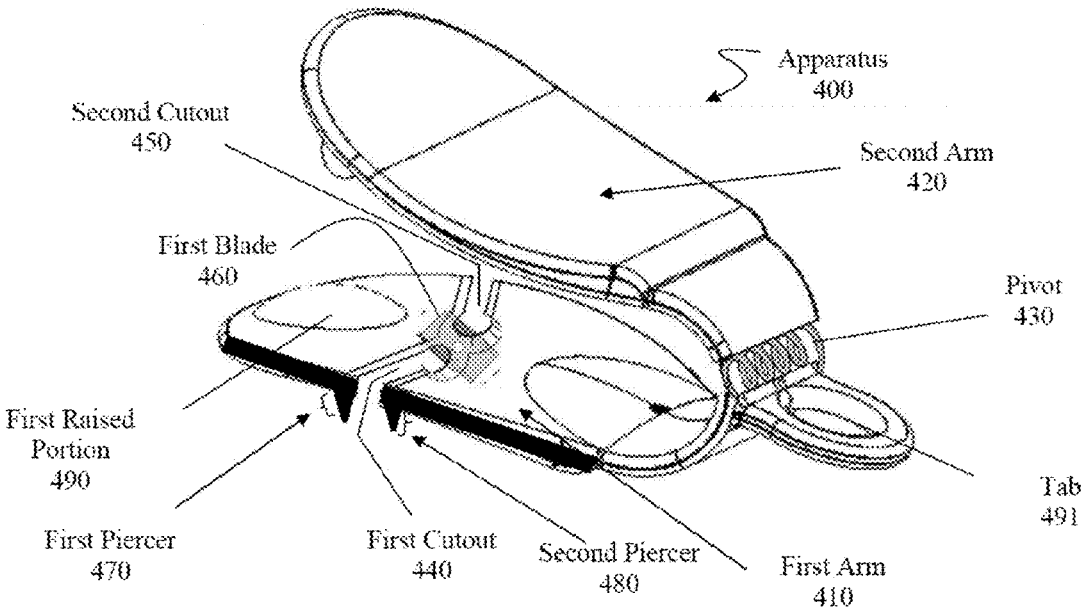
FIG. 4 is a side, rear perspective view of yet another embodiment of a bag cutter.

FIG. 4 shows a bag cutter having a pivot, two cutouts, and piercers extending from the cutouts. Apparatus 400 comprises a second arm 420 having a blade (not shown), coupled to first arm 410 via a pivot 430 (e.g., a coil, a piece of material, a bend, a magnetic strip, or any other suitable pivot). First arm 410 comprises first and second cutouts (440 and 450, respectively), each of which expose an edge of first blade 460. First arm 410 further comprises first and second piercers (470 and 480, respectively), which are extensions of edges of first and second cutouts. Raised portion 490 is configured to juxtapose an edge of the second arm 420's blade when first arm 410 and second arm 420 are squeezed together.

In some other embodiments, first arm is continuous with second arm via a single piece of shared material.

A hanger accepter (e.g., tab 491) can be located on any portion of any arm or pivot and can be configured to accept a hook or other hanger. It is also contemplated for a bag cutter to have various safety features, including, for example, a locking strap, and a ridge in one or both of the arms to help prevent a user's fingers from sliding off the arm.

Figure 5:
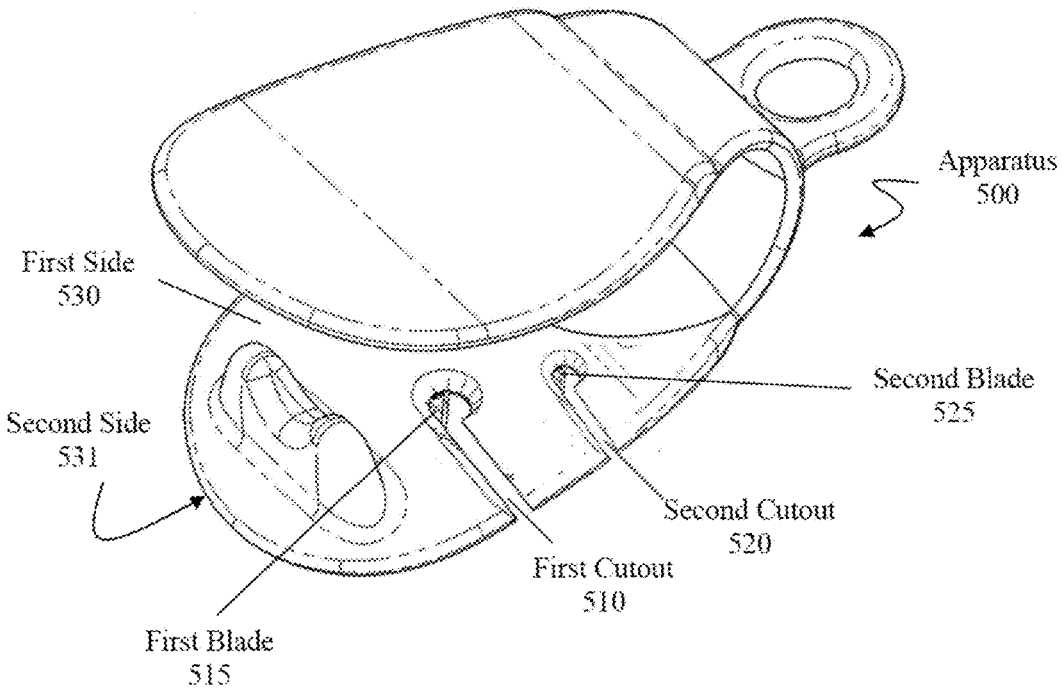
FIG. 5 is a top perspective view of another bag cutter.

FIG. 5 shows apparatus 500 having first cutout 510 and second cutout 520, each partially embedding a different blade. First cutout 510 partially embeds and exposes first blade 515, and second cutout 520 partially embeds and exposes second blade 525. Each blade, 515 and 525, is disposed between first side 530 and second side 531, such that the only way to access either blade is via a cutout.

Blades can be made of any suitable material, including steel, ceramic, and plastic, and can have flat, concave or convex edges. Blades made with one or more non-optimal materials can optionally have suitable coatings, including for example Teflon$^{TM}$ or other friction-reducing coating, and metal coatings or other corrosion-resistance coatings. Stops can be included to control cutting depth. Each blade is preferably embedded in such a way that at least a portion of an edge of a blade is exposed at all times.

Figure 6:
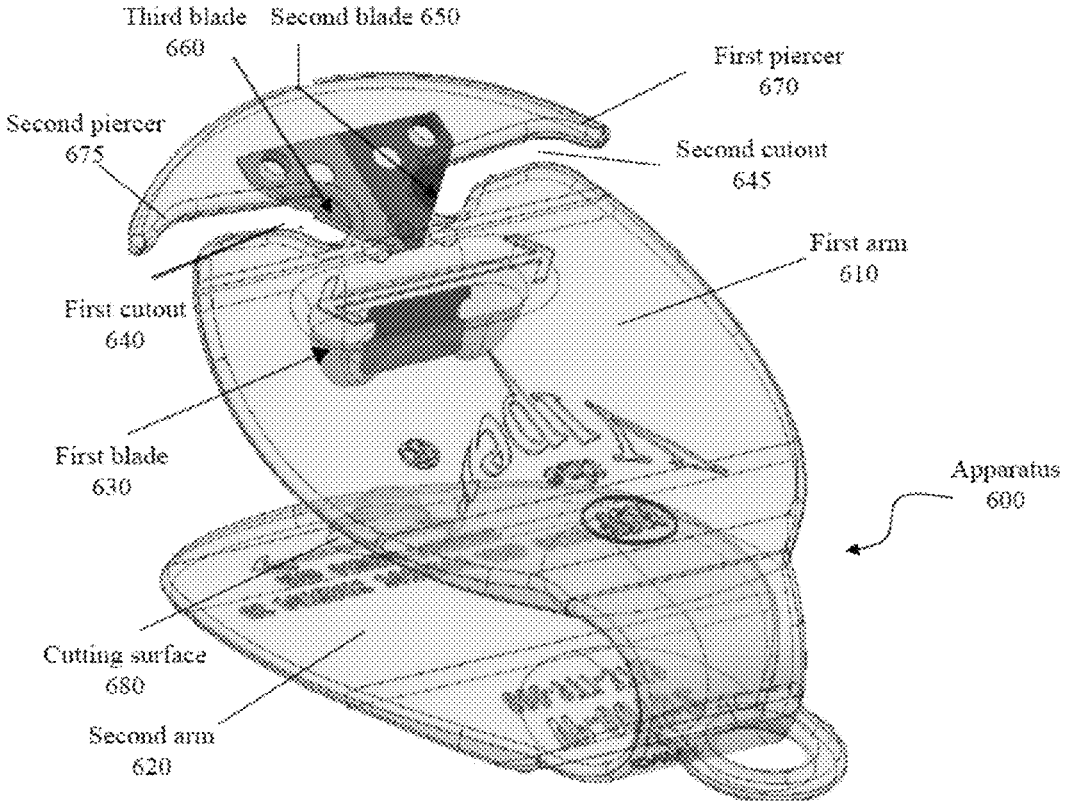
FIG. 6 is a side, rear perspective view of an embodiment of a bag cutter having three blades.

FIG. 6 shows an embodiment of the inventive subject matter having three blades, two cutouts, a cutting surface, and two piercers. Apparatus 600 is a versatile bag cutter and piercer that is configured to allow a user to open different types of bags and other objects. The first arm 610 comprises three different blades, 630, 650, and 660. First blade 630 is partially embedded in first arm 610 and configured so that an edge of first blade 630 can juxtapose cutting surface 680 of second arm 620 when first arm 610 and second arm 620 are squeezed together. Second blade 650 and third blade 660 are each disposed between a first side and a second side of first arm 610. In this embodiment, an edge of second blade 650 is exposed via second cutout 645, and an edge of third blade 660 is exposed via first cutout 640. In some embodiments, it is contemplated that a single blade could comprise two or three edges that can be exposed via two or three different cutouts, respectively.

Apparatus 600 further comprises a first piercer 670 and second piercer 675. A piercer can be used to pierce one side of a bag, so that a bag can be opened on a single side. In other words, a strip of the bag does not need to be removed in order to open a bag. Instead, a user can simply pierce one side of the bag and create a cut using a cutout and corresponding blade edge.

Figure 7:
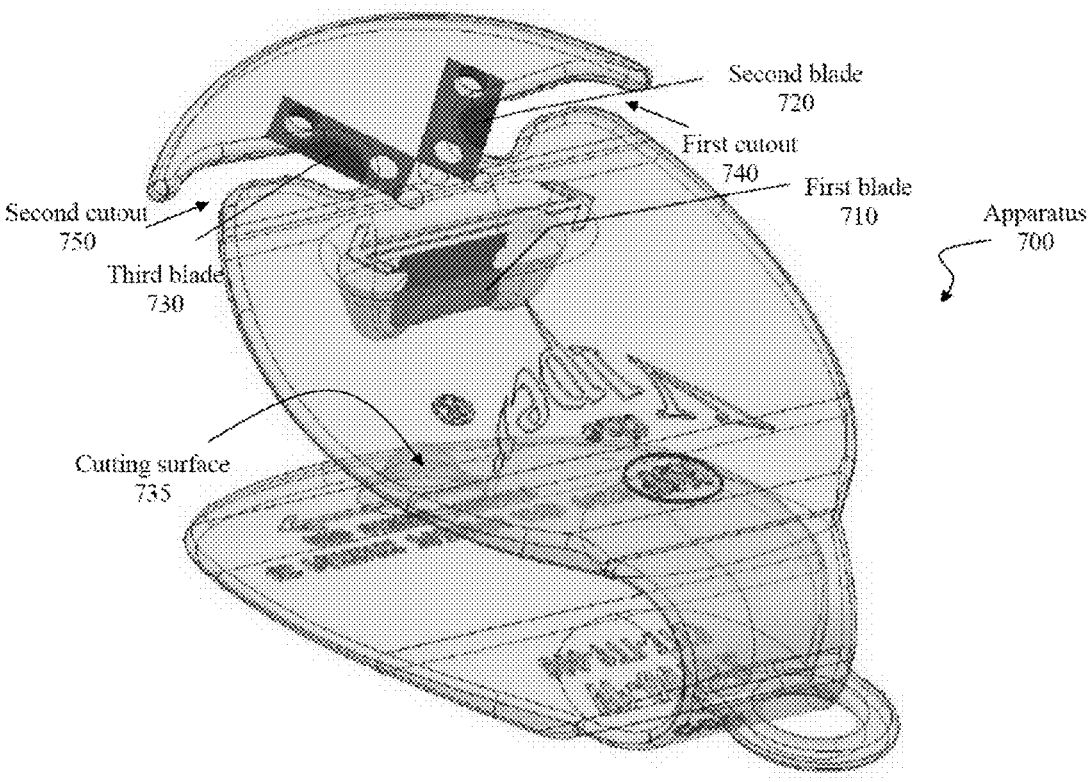
FIG. 7 is a side, rear perspective view of an embodiment of another bag cutter having three blades.

FIG. 7 shows another embodiment of the inventive subject matter. Apparatus 700 is similar to apparatus 600 and comprises three separate blades (710, 720, and 730). First cutout 740 and second cutout 750 expose a portion of second blade 720 and third blade 730, respectively. In this embodiment, second blade 720 and third blade 730 are rectangular in shape. However, it is contemplated that a blade can comprise any suitable size and shape, including for example, a trapezoid, or a triangle.

Figure 8:
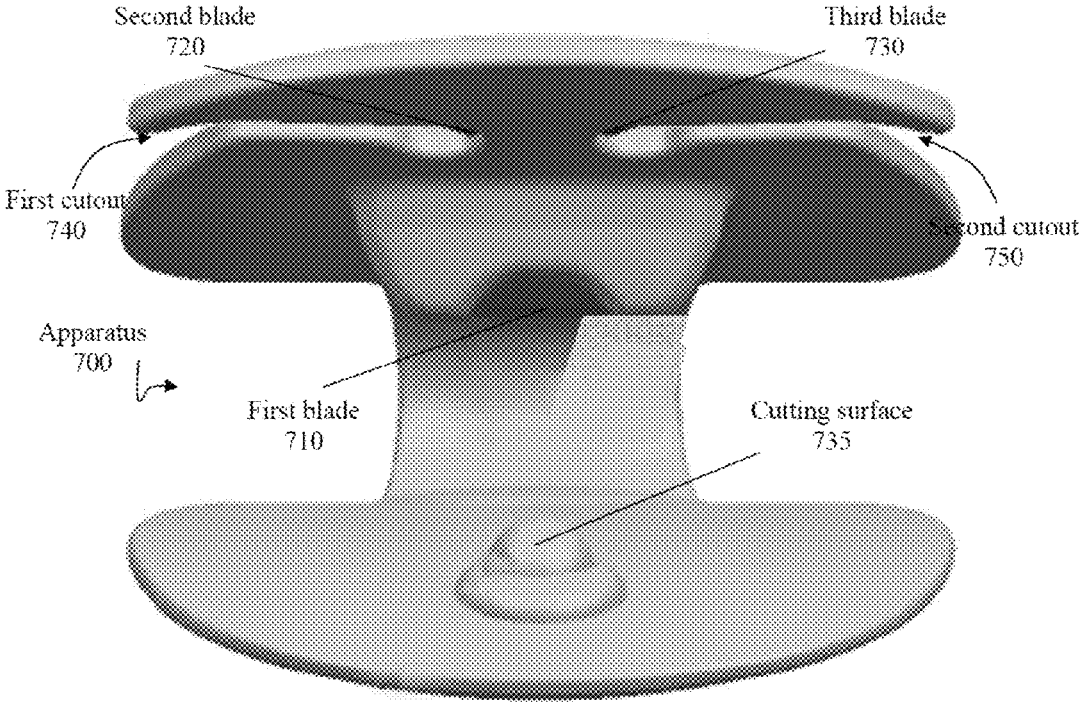
FIG. 8 is a front perspective view of the bag cutter of FIG. 7.

Apparatus 700 further comprises cutting surface 735, configured to juxtapose an edge of first blade 710 when apparatus 700 is squeezed together. FIG. 8 is a front perspective view of the apparatus of FIG. 7.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cutting and piercing apparatus comprising:

a first arm having a first side and a second side that define a thickness of the first arm;

a second arm operable in conjunction with the first arm and having a first side and a second side that define a thickness of the second arm;

a first blade comprising an edge, wherein the edge has a first end, a second end and a central portion;

wherein at least one of the first arm and the second arm partially encloses the first blade at the first end and the second end in a manner that exposes the central portion of the edge of the first blade, and wherein portions of the at least one of the first arm and the second arm partially enclosing the first end and the second end project beyond the central portion;

wherein at least one of the first arm and the second arm comprises a cutting surface that is juxtaposable against the central portion of the edge of the first blade; and wherein the first arm comprises:

a first cutout at least partially enclosing a second blade disposed between the first and second sides that define the thickness of the first arm; and a piercer configured to pierce a workpiece, and disposed at a periphery of the first arm.

2. The apparatus of claim 1, wherein the piercer comprises an obtuse tip.

3. The apparatus of claim 1, wherein the first cutout and the piercer at least partially overlap, such that a user could pierce and cut a workpiece simultaneously.

4. The apparatus of claim 1, wherein the piercer is an extension of an edge of a cutout.

5. The apparatus of claim 1, wherein the first arm further comprises a second cutout at least partially enclosing the first blade.

6. The apparatus of claim 1, wherein the first arm is made of plastic.

7. The apparatus of claim 1, wherein the first arm further comprises a second cutout at least partially enclosing a second blade disposed between the first and second sides of the first arm.

8. The apparatus of claim 1, wherein the cutting surface comprises at least one of an anvil and a raised portion.

9. The apparatus of claim 8, wherein the cutting surface comprises an anvil at least partially embedded in the at least one of the first arm and the second arm.

10. The apparatus of claim 9, wherein the anvil is completely embedded in the at least one of the first arm and the second arm.

11. The apparatus of claim 1, wherein the second arm comprises the cutting surface, and wherein the cutting surface comprises an anvil.

12. The apparatus of claim 11, wherein the cutting surface comprises an anvil at least partially embedded in the second arm.

13. The apparatus of claim 11, wherein the cutting surface comprises an anvil completely embedded in the second arm.

14. The apparatus of claim 1, wherein the first arm is continuous with the second arm.

15. The apparatus of claim 1, wherein the first arm is continuous with the second arm at a pivot.

16. A cutting and piercing apparatus comprising:

a first arm and a second arm;

wherein the first arm comprises:

a first side and a second side;

a first cutout at least partially exposing a first edge of a first blade disposed between the first and second sides; and a piercer;

wherein at least one of the first arm and the second arm comprises a cutting surface; and wherein at least one of the first arm and the second arm comprises a second blade partially embedded therein; and wherein the second blade comprises an edge having an embedded first end, an embedded second end and an exposed central portion, wherein portions of the at least one of the first arm and the second arm embedding the first end and the second end project beyond the central portion, and wherein the central portion is juxtaposable with the cutting surface.

17. The apparatus of claim 16, wherein the first arm further comprises a second cutout at least partially exposing an edge of the first blade.

18. The apparatus of claim 16, wherein the first arm further comprises a second cutout at least partially exposing an edge of a third blade disposed between the first and second sides.

19. The apparatus of claim 16, wherein the cutting surface comprises an anvil.

* * * * *